United States Patent [19]

Lupton

[11] Patent Number: 4,909,575

[45] Date of Patent: Mar. 20, 1990

[54] ROAD CUTTING EQUIPMENT

[75] Inventor: William G. Lupton, Ripon, England

[73] Assignee: Econ Group Limited, Yorkshire, England

[21] Appl. No.: 215,422

[22] Filed: Jul. 5, 1988

[30] Foreign Application Priority Data

| | | | |
|---|---|---|---|
| Jul. 4, 1987 | [GB] | United Kingdom | 8715777 |
| Jan. 5, 1988 | [GB] | United Kingdom | 8800145 |
| Apr. 8, 1988 | [GB] | United Kingdom | 8808195 |

[51] Int. Cl.[4] ..... E01C 23/08

[52] U.S. Cl. ..... 299/39; 404/90; 180/24.02; 280/704

[58] Field of Search ..... 299/36–40; 404/90, 91, 85, 75; 172/23, 98; 173/22, 23; 241/101.7; 37/86, 92, 189; 180/24.02; 280/704

[56] References Cited

U.S. PATENT DOCUMENTS

| | | | |
|---|---|---|---|
| 1,782,690 | 11/1930 | Kerr | 172/23 |
| 2,044,684 | 6/1936 | Haigh | 404/85 |
| 2,890,872 | 6/1959 | Hall | 299/40 |
| 3,606,467 | 9/1971 | Christensen et al. | 299/39 |
| 3,767,262 | 10/1973 | Pentith | 299/39 X |
| 4,175,886 | 11/1979 | Moench et al. | 299/40 X |
| 4,256,344 | 3/1981 | Hatcher | 299/39 |
| 4,262,966 | 4/1981 | Bouplon | 299/39 |
| 4,333,686 | 6/1982 | Arnswald | 299/39 |
| 4,516,808 | 5/1985 | Staab et al. | 299/39 |
| 4,588,231 | 5/1986 | Silay et al. | 299/39 |
| 4,762,371 | 8/1988 | Lupton | 299/39 |

FOREIGN PATENT DOCUMENTS

| | | | |
|---|---|---|---|
| 1925243 | 11/1970 | Fed. Rep. of Germany | 299/39 |
| 2648068 | 11/1977 | Fed. Rep. of Germany | 404/90 |
| 3420989 | 12/1985 | Fed. Rep. of Germany | 299/39 |

*Primary Examiner*—Jerome W. Massie, IV
*Assistant Examiner*—Matthew Smith
*Attorney, Agent, or Firm*—Fred Philpitt

[57] ABSTRACT

The invention comprises a road cutting equipment for cutting grooves, or slots in road surfaces and comprises an apparatus attached to an end of a vehicle. When the apparatus is not in use it is raised clear of the road surface so that the vehicle can travel over the road surface in normal fashion. When the equipment is to be used it is lowered relative to the vehicle and the vehicle is supported by the equipment on legs of which the lower ends have rollers. At the same time a cutter disc or drum is driven and penetrates the road surface. The equipment in this condition is driven forward, by a drive means which directly drives one or more of said rollers.

15 Claims, 10 Drawing Sheets

ROAD CUTTING EQUIPMENT

This invention relates to road cutting equipment, and provides a means whereby a cut or cuts can be made in a road surface for the purposes of, for example, gaining access to service pipes and cables, laying new service pipes or cables, road work patching and repair and the like.

When it is desired to open up a road surface, for example to gain access to service pipes and cables, it is necessary to cut through the road surface which typically may be tarmacadam of a concrete mixture. In any event the road surface is usually of relatively hard or brittle material and cutting therethrough is a relatively slow process. Typically, such cutting is usually performed by jackhammers or pneumatic drills which tend to result in rather roughly cut edges in the road surface, and when the work has been completed, and any holes or channels formed in the road have been refilled, the hole or channel has to be re-surfaced. Resurfacing is facilitated and the end result is aesthetically better if the edges of the hold of the road surface or other edges of the channel are clearly defined, and the edges are sharp and straight.

Accordingly, it has been proposed to provide road cutting equipment in the form of rotary cutting means which either cuts slots in the road surface, or channels in the road surface, the latter equipment being referred to as a planing machine and the rotary means being a drum which cuts through the road surface over the entire drum width.

Various road cutting machines of this type have been proposed, and they vary from large custom built, self-propelled machines to smaller attachment units for connection to other types of vehicles, such as agricultural tractors or other road working machines such as JCB excavators.

Road cutting can be performed either "hot" or "cold". In hot road cutting (usually used for tarmacadam surface) the road surface is heated to soften same, thereby to lighten the load on the cutting tools, In cold cutting, not heat is used and therefore the load and vibration on the cutting tools is greater. As will be appreciated, hot cutting machines are usually bulky custom built machines suitable only for road cutting, but with cold cutting machines, these may be attachments to, for example, vehicles.

The present invention concerns attachments to vehicles of which a known version comprises an excavator machine which runs on large, pneumatic tire wheels. The excavator is fitted with a rotary road cutting means, which can be lowered into contact with the road surface. The vehicle can then be driven forward at a slow speed using a special creep speed gearbox provided in the machine and which can be drivingly connected to the wheels, in order to provide for the cutting of slots or a groove in the road surface as the vehicle progresses forward at creep speed.

A disadvantage of this arrangement is, that because the vibrations which result from the cutting operation and because the excavator runs of the pneumatic tires the excavator in fact "jumps" during the cutting operation making the cutting uneven and ragged.

A machine for road cutting is disclosed in U.S. Pat. No. 3606467, the machine comprising a vehicle having a hydrostatic transmission, and attached to the rear of the vehicle is an assembly which overhangs the rear of the vehicle, and can be jacked up and down so as to bring the assembly into contact with the ground for road cutting, or clear of the ground for transportation. When the assembly is in contact with the ground, it can be jacked onto the ground to raise the rear wheels of the vehicle and the vehicle is propelled by the front wheels through the hydrostatic transmission. The assembly is provided with its own prime mover for driving a cutter drum which engages the ground specifically for the cutting of parallel grooves in a concrete pavement.

The utilisation of the hydrostatic transmission for the propelling of the vehicle when the assembly is raised and also for the propelling of the vehicle when the assembly is in contact with and cutting the concrete pavement places a limitation on the flexibility of the machine, and in fact increases the expense of the machine requiring it to be custom built.

The present invention seeks to provide a machine of the nature described above, but wherein greater flexibility of cutting and transportation are achieved.

The present invention seeks to provide an improved form of equipment of this nature and which in its preferred form can provide for smoother operation of the equipment for the elimination of the creep gearbox on the one hand, and on the other hand in its preferred form can provide for increased flexibility as regards the positioning of the cutting means laterally of the direction in which the vehicle progresses.

In accordance with the present invention there is provided road cutting equipment comprising a traction vehicle having ground engaging wheels or tracks on which the vehicle can run in travelling from place to place and a cutting and supporting apparatus at one end of said vehicle, said apparatus comprising a cutting head having a road cutting means, support leg means having roller means at the lower ends thereof, said cutting head and said support leg means being movable between a raised transport position in which the cutting head and the support leg means are clear of the road surface on which the vehicle stands and over which the vehicle can be moved, and a lowered working position in which the leg means takes the weight of the adjacent end of the vehicle and the cutting means engages the road surface for the cutting of same, and including means for driving the equipment along the road surface whereby, by the combining operation of the cutting means and movement of the equipment, grooves and/or slots can be cut in the road surface, characterised in that the means for driving may be coupled to drive the roller means.

The cutting head is preferably mounted on a beam or frame and the leg means are arranged at the ends of said beam or frame.

The beam or frame preferably lies transversely to the direction in which the combination is progressed by the means for driving. When the cutting head is mounted on a beam, the cutting head preferably is movable, for example by means of hydraulic ram or the like longitudinally of the beam thereby to position the cutting head at any desired lateral position widthwise of the direction of progression of the combination.

The cutting means preferably comprises rotary disc means or a rotary drum arranged when attached to a vehicle with the axis of rotation horizontal and transverse to the fore and aft direction of the vehicle, and the cutting head is preferably mounted on the rear of the vehicle and the vehicle having front steerable wheels whereby the combination can be steered whilst being progressed. The vehicle may be capable of being driven in either direction by the means for driving and to this end the vehicle may have a cabin or other location for an operator or driver whereat there are seat means enabling the driver to face forwards or rearwards whilst seated.

The said rotary disc means or rotary drum may be carried by a bracket and a vertical pivot whereby the disc means or drum can be pivoted so that said axis of rotation can be positioned at 90° to the right or left of said position in which the said axis is transverse to the fore and aft direction of the vehicle.

The means for driving preferably comprise slow speed hydraulic motor means coupled to the roller means, and the hydraulic motor may be adapted to be supplied with hydraulic fluid for the driving of same from a hydraulic circuit powered by the vehicle prime mover.

The vehicle may be any conventional traction vehicle, such as JCB, tractor, lorry or the like, and to this end the invention also includes the various parts and means adapted to be connected to the vehicle in order to provide the said equipment.

The said means may comprise legs in telescopically interfitting sections with fluid pressure operable rams or other means such as screw jacks between the sections for extending and contracting the legs. The legs may be attached to the ends of the beam of frame, and the beam or frame and the legs may be adapted to be raised and lowered as a unit relative to the vehicle by means of a hydraulic ram and pivoting links arrangement (which may be the conventional three point linkage of an agricultural tractor) in order that the weight of the rear of the vehicle will be taken on the legs when the rear wheels or tracks of the vehicle are raised out of contact with the ground, when the cutting operation is taking place. The roller means at the bottom of the legs may comprise solid rubber tired wheels to eliminate "bounce" and "jump" of the vehicle during the cutting operation.

There may be a second pair of legs usable as alternatives to said first mentioned legs, said second pair of legs having flat feet which simply support the rear of the vehicle, when for example the disc or drum is cutting a slot which is transverse to the fore and aft direction of the tractor, by being moved along the beam.

In an alternative arrangement, the legs may be provided on the vehicle as a normal fitting thereof, and such may be the case when for example the vehicle is a JCB excavator, as the excavator does have a mounting frame at the rear thereof with extensible legs which can be lowered onto the ground in order to raise the rear of the vehicle. In this case it is desirable that the cutting head should be capable of being raised and lowered relative to the legs.

The cutting means may be power driven by any suitable means, such as the power take off shaft of the tractor and appropriate gearing, or by a hydraulic motor supplied with hydraulic fluid from the tractor hydraulic circuit, or an auxiliary power source.

In a particularly advantageous arrangement the cutting head is supported on a mounting which overhangs the side of the vehicle so that the cutting unit can be arranged to cut the surface of footpaths whilst the vehicle travels on a road adjacent the footpath.

The present invention therefore provides a means whereby long slits or cuts in road surfaces including footpaths and sidewalks can be made without difficulty, and at least in one embodiment of the invention the position of the slits or cuts widthwise of the vehicle can be readily adjusted. Also, at least in some embodiments transverse slits or grooves can be cut by pivoting the cutting head and by moving it along a beam whilst the cutting means is in engagement with the road surface.

The cutting means may comprise as indicated herein a cutting drum or a pair of cutting discs in order to cut parallel slits in the road surface. The spacing of the discs can be adjusted in order to cut slits which are further apart or closer together depending upon the width of the channel which is to be cut in the road surface.

In a further embodiment, the attachment comprises a single arm carrying a cutter and a road engaging roller, with a drive means connected to the roller. The single arm preferably is adapted to be moved transversely of the rear of the vehicle to any desired position. Where the vehicle is an excavator vehicle, the slide used for supporting the excavator arms may also be used for the support of the road cutting attachment, and the said road cutting attachment and excavator arms may be mounted side by side on the same slide so that following road cutting, the excavator arms may be used for digging a trench between slots cut in the road.

In any case a neat relatively straight edged cut can be made quite simply, and as the vehicle can be steered, the position of the cut in relation to the roadside can be maintained easily, especially when the vehicle is driven in a direction in which the cutting head moves in advance of the vehicle.

Embodiments of the invention will now be described, by way of example, with reference to the accompanying diagrammatic drawings, wherein:

FIG. 1 is a perspective view of the cutting and supporting apparatus according to one embodiment of the invention;

FIGS. 2 and 3 respectively show how the equipment including the apparatus of FIG. 2 is used;

Figure 2:
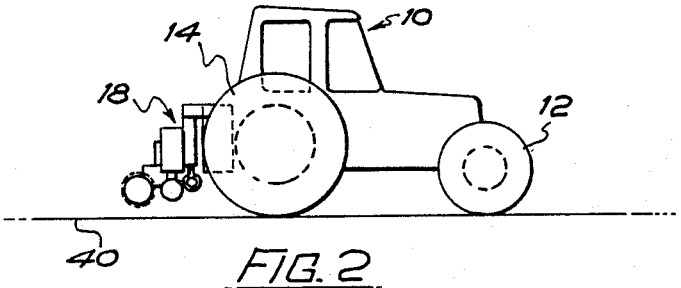
Figure 3:
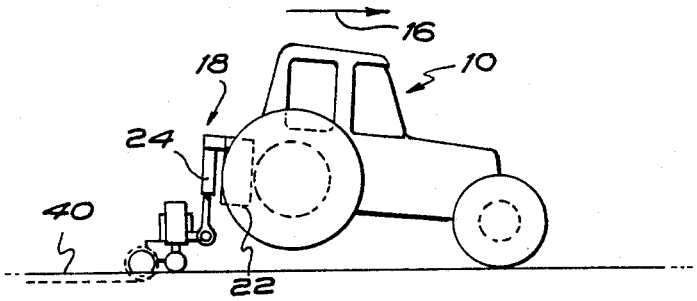

Referring to the drawings, in FIGS. 2 and 3 is shown a tractor vehicle 10 which may be of conventional type, the tractor having front and rear pneumatic tired wheels 12 and 14 being adapted in normal forward movement to travel in the direction indicated by arrow 16.

Figure 1:
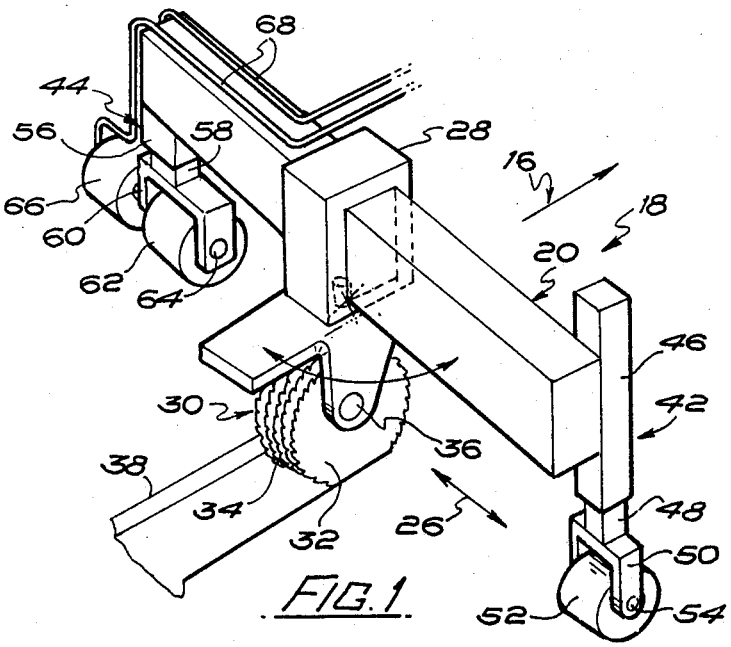

To the rear of the tractor is attached the apparatus shown in FIG. 1 and the apparatus is indicated generally by reference 18.

Referring to FIG. 1, the apparatus shown comprises a beam 20 which extends transversely across the rear of the tractor, and is connected to part of the tractor chassis 22 by means of fluid pressure operated ram 24 or other means for raising and lowering the beam 20. slidable on the beam 20 in a direction indicated by arrow 26 is a yoke 28 of a road surface cutting head 30 which comprises a cutting means in the form of a drum 32 having cutting teeth 34 thereon. The drum 32 is rotatable about an axis defined by a spindle 36 which extends in a direction parallel to beam 20, and the cutting head 30 is provided with a suitable power drive means such as hydraulic or electric motor, which is not shown in FIG. 1, so that the drum 32 can be rotated in either direction in order to cut a trench 38 in the roadway surface 40 as indicated in FIG. 1, by the combined movement of the tractor in the direction of arrow 16 (or the opposite direction as will be explained hereinafter) and the rotation of the drum.

There is a means for adjusting the yoke 28 as indicated by the arrow 26, but again such means is not shown in FIG. 1. Examples are shown in other figures. It could be for example a fluid pressure operated ram means either coupled directly to the yoke 28, or coupled thereto through a suitable chain and pulley arrangement to give the required length of travel between the ram means and the yoke movement.

The cutting drum 32 could be replaced by spaced cutting discs if it is required to cut slots in the road surface 40 to define a trench which is subsequently excavated by suitable excavating means. Such excavating means may be provided on a separate vehicle, or may suitably be mounted on the vehicle 10.

The beam 20 carries at its ends leg means 42 and 44 which are shown as being of different construction, but the leg means could be identical if required. The leg means 42 comprises telescoping leg ports comprising an outer casing 46 and an inner strut 48, between which are means such as a hydraulic ram or screw jack for relatively telescoping the leg parts. On the lower end of the strut 48 is a wheel bracket 50 which supports a roller means in the form of a rotatable ground engaging wheel 52 which is rotatable about the spindle 54. The wheel 52 may be mounted so as to be capable of castoring if desired. The wheel 52 may be a solid metal roller or it may be provided with a solid rubber tyre to eliminate "jump" during cutting.

The respective telescopic parts 46 and 48 of the leg 42 can be moved relatively by means of a fluid pressure operated ram inside the leg (not shown) whereby the wheel 52 for the purposes of controlling the depth to which the cutter 30 penetrates the ground surface.

At the other end, the leg 44 again is in telescopically interfitting parts 56 and 58, the part 58 carrying a bracket 60 to support a ground engaging wheel 62 (of similar form to wheel 52) carried by spindle 64. The spindle 64 is drivingly connected to a hydraulic or other drive means 66 which in the example shown is a hydraulic motor supplied with hydraulic fluid through pipes 68, from the power system of the tractor 10, whereby the motor 66 can be rotated in either direction in order to propel the combined vehicle and road cutting equipment in the direction of the arrow 16 or in the opposite direction in a manner now to be explained.

If the FIG. 1 apparatus is not in use, as shown in FIG. 2 the tractor 10 rests by its wheels 14 and 12 on the ground surface 40, and the apparatus 18 is clear of the ground whereby the tractor can travel over the ground in its normal functioning mode, and at the normal tractor speed. However, when it is desired to cut a trench 38 or slots in the ground 40, the legs 42, 44 are adjusted relative to the cutting head 30 to set the depth of cut in the road surface required, and the apparatus 18 is lowered by the ram 24 whilst the cutting head is rotating until the cutting head penetrates the ground to the predetermined depth, the wheels 52 and 62 engage the ground and the rear end of the tractor as shown in FIG. 3 is jacked clear of the ground so that the tractor weight is applied to the ground through the apparatus 18. When the motor 66 is driven, which causes driving of the wheel 62, the whole equipment creeps forward as indicated by arrow 16 (or rearwards), and at the same time the cutter 30 cuts a channel or slits in the road surface.

Figure 4:
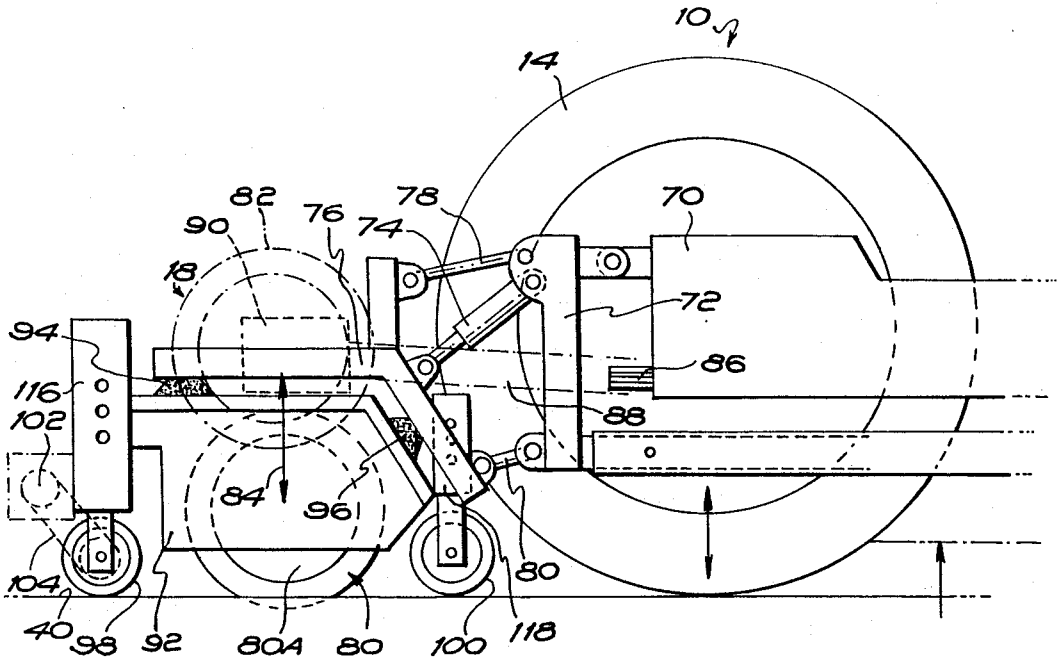
FIG. 4 is a side view illustrating another embodiment of the invention.

Referring now to the embodiments of the invention shown in FIG. 4, which shows an alternative form of apparatus attached to the rear of the tractor 10, in this case there is attached to the tractor chassis 70 a supporting frame 72, and carried by this frame are lifting rams 74 pivotally connected between frame 72 and a frame 76 of the apparatus 18. Pivot links 78 and 80 also connect the frame 76 and frame 72, the arrangement being that by expansion and contraction of the ram 74, so the frame 76 can be raised and lowered relative to the rear of the tractor. The cutting head is indicated by reference 80, and is shown in full lines in the down or operating position, whilst it is also shown in dotted lines by reference 82 in the raised or out of use position, the capability of movement of the cutter unit 80 being indicated by arrow 84. The ram 74 is under the control of the driver of the tractor, and is supplied with hydraulic fluid from the tractor hydraulic circuit.

The cutting head 80 is powered from the power take-off shaft 86 of the tractor there being a shaft 88 which couples shaft 86 to a gearbox 90 by means of universal couplings (not shown) to enable the shaft to pivot between the lower and upper positions of the cutting head 80. The gearbox 90 has its output connected to the drive shaft of cutting drum, disc or discs 80A to provide any desired gear reduction ratio between shaft 86 and the cutter drum 80A.

In fact, the cutting head 80 is mounted on a sub-frame 92 connected to frame 76 through rubber isolation bushes 94 and 96 whereby impact and vibrations experienced by the cutting head 80 during operation will be dampened in relation to the frame 76 whereby the tractor will be substantially isolated from these vibrations and impact. Such vibration isolation means can also be used in the FIG. 1 embodiment.

The sub-frame 92 carries extensible leg means 116 and 118 which are of somewhat similar construction to the legs 42 and 44 described in relation to FIG. 1 in that wheels 98 and 100 (similar to wheels 52 and 62) thereof can support the raised end of the tractor in the manner described in relation to FIG. 3.

In the arrangement shown in FIG. 4, the wheel 98 is drivable by a hydraulic motor 102 in much the same fashion as hydraulic motor 66 drives wheel 62, except that motor 102 is coupled to wheel 98 by means of a chain and sprocket arrangement 104.

Figure 5:
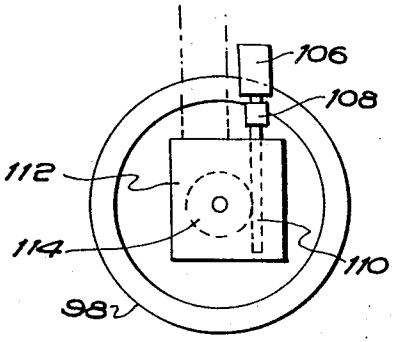
FIG. 5 is a side view of an enlarged scale illustrating an alternative method of propelling the equipment of FIG. 2 or FIG. 4.

FIG. 5 shows an alternative arrangement for driving the wheel 98, and in this case the hydraulic motor 106 is connected through a coupling 108 to the worm 110 of a worm and worm wheel gearbox 112 of which the worm wheel 114 is co-axial with and connected to the shaft of the roller 98.

There may be two wheels 98 and two wheels 100 at respective sides of the tractor, or it is possible to have only two of said wheels one at each side of the tractor. One or each of the wheels may be power driven in the manner of the power drive illustrated for the wheel 98.

In a further modification, the input of gearbox 90 may be coupled to drive the cutter means 80A by means of a chain drive or v-belts.

The operation of the arrangement shown in FIG. 4 is essentially identical to that shown in FIG. 1 except that the cutting unit is not mounted to be transversely movable as indicated by arrow 26 in FIG. 1. During transport of the equipment, when vehicle 10 can be driven for example on the roads at normal speed, the ram 74 is retracted, and the equipment is raised clear of the ground (position shown by 82). When the vehicle reaches the site where working is to be effected, after setting the wheels 98, 100 in position in relation to cutting means 80A, the ram 74 is extended until initially the cutter means 80A whilst being driven engages the ground surface 40. The cutter means 80A engages and cuts the road and the frame continues to be lowered until the wheels 100 engage the road surface limiting the extent to which the cutting means 18A penetrates the road surface. Further extension of ram 74 causes the rear wheels 14 of the tractor to be raised clear of the ground so that the rear weight of the tractor is taken through the equipment. The whole equipment can now be propelled by the driving of the roller 98 as described herein, enabling a continuous groove or continuous slots to be cut in the road surface 40.

Figure 6:
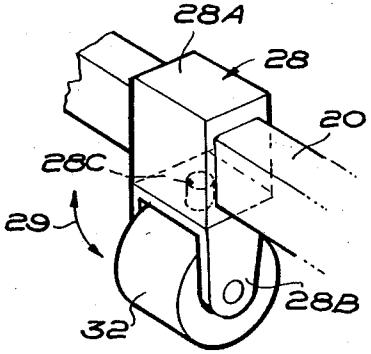
FIGS. 6 and 7 are views similar to FIG. 1, but showing a modification of the cutting head.
Figure 7:
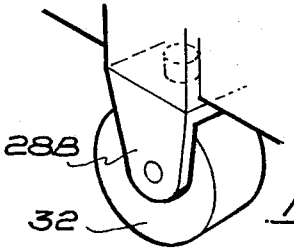

Referring now to FIGS. 6 and 7 in which modification of the arrangement shown in FIG. 1 is shown, it will be seen that the yoke 28 is in fact in two parts namely the block 28A which slides on the beam 20, and a bracket 28B which carries the cutting drum 32. The bracket 28B is connected to the block 28A by a pivotal connection 28C enabling the bracket to be turned as indicated by the arrow 29 relative to the beam 20 90° to the left or right of the position shown in FIG. 1 and FIG. 6, such pivoting being about the vertical pivotal axis defined by pivot pin 28C. The means for pivoting the bracket 28B is not shown, but may comprise a hydraulic ram or the like, duly controlled by the vehicle operator. FIG. 7 shows the bracket 28B turned through 90° relative to the FIG. 1 and FIG. 6 positions, and if the yoke 28 is now moved along the beam 20 by suitable displacement means whilst the cutter drum 32 is driven, and of course whilst the vehicle is stationary but raised on legs 42 and 44 a strip can be cut transversely of the fore and aft direction of the vehicle. By this means the cutter means can be made to cut round the transverse edges of for example a square or rectangular area removed from the road surface by the method of FIG. 3 so that all of the edges of said cut area are sharp and clearly defined. Additionally, it may be required of the machine simply to cut a strip transversely of the road surface for the purposes of road surface repair or access to or laying of cables and mains. It will be appreciated that when the equipment is operating in this mode, there is no forward movement of the tractor and the planing attachment.

In order to assist the operation of the equipment when the cutting drum is moving transversely as described, it may be desirable to provide a further set of support feet at the ends of the beam 20, such support feet comprising essentially flat plates or blocks and supported by legs similar in construction to the legs 42, 44 already described, so that the feet of the second pair of legs can be raised and lowered similar to the rolling elements 52 and 62 of the legs already described. When the cutter is moving to make a transverse cut, the flat feet are used to support the rear of the vehicle, the rollers 52 and 62 being retracted clear of the ground.

Figure 8:
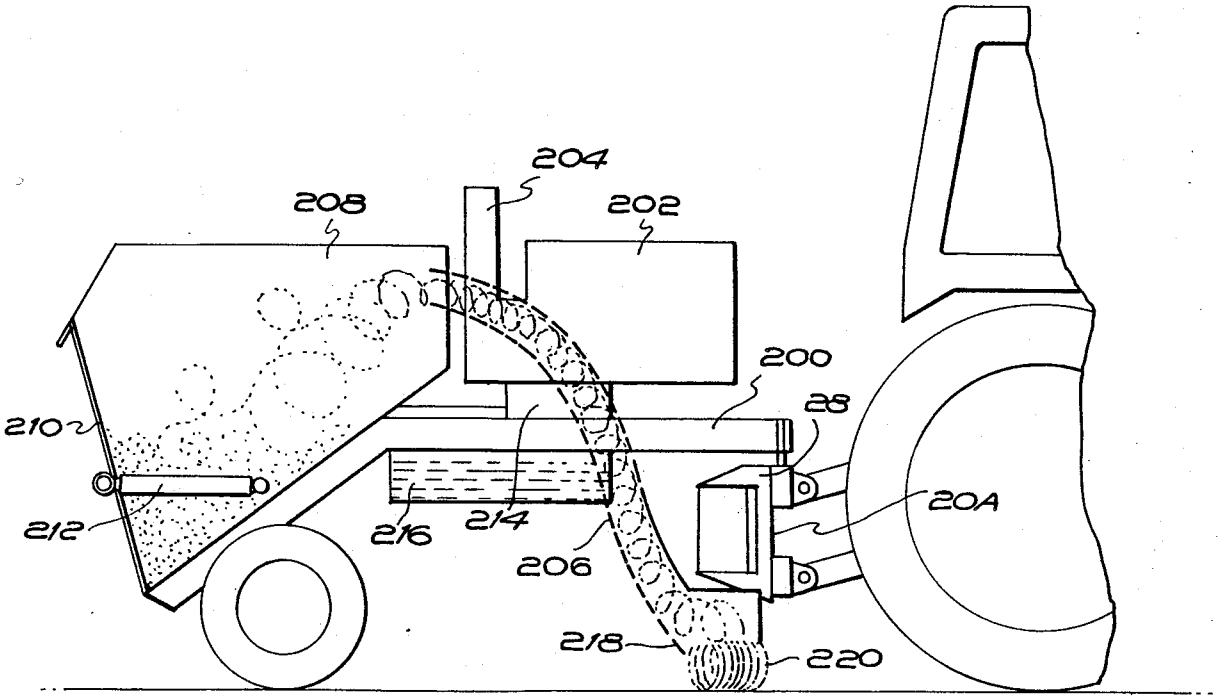
FIG. 8 shows a means for collecting spoil.

FIG. 8 shows a further useful feature in connection with the planing equipment of any of the embodiments as described herein.

FIG. 8 shows a trailing attachment for connection in this example to the frame 20A, the trailing attachment comprises a chassis 200 which supports an engine 202 and a suction fan 204. The suction fan draws a vacuum through a delivery pipe or hose 206 which may be flexible in nature and is arranged to draw debris and spoil from the ground in the vicinity of the cutting disc or drum and to discharge it into a hopper 208 provided with a rear door 210 which can be opened and closed by means of hydraulic rams 212 operated from the vehicle hydraulics. The chassis 200 may also support a fuel tank 214 for the engine 202, and a water tank 216 when it is required to arrange for the spraying of water on to the road surface in order to minimise the creation of dust as a result of the road cutting.

In the vicinity of the inlet end of the pipe 206 as indicated by numeral 218, there is a power driven brush 220 which serves to brush the spoil and debris created by the planing or cutting operation, and the suction applied to the pipe 206 draws this debris and spoil from the vicinity of the cutting drum or disc and discharges it directly into the hopper 208.

The inlet end of the pipe 218 and the power brush which may have its own electric or hydraulic motor for driving same preferably are connected to the yoke 28, and in particular in the case of the FIGS. 6 and 7 embodiment is connected to the pivotable portion 28B so that the brush and suction nozzle will always be at the same disposition in relation to the cutting drum or discs.

Figure 9:
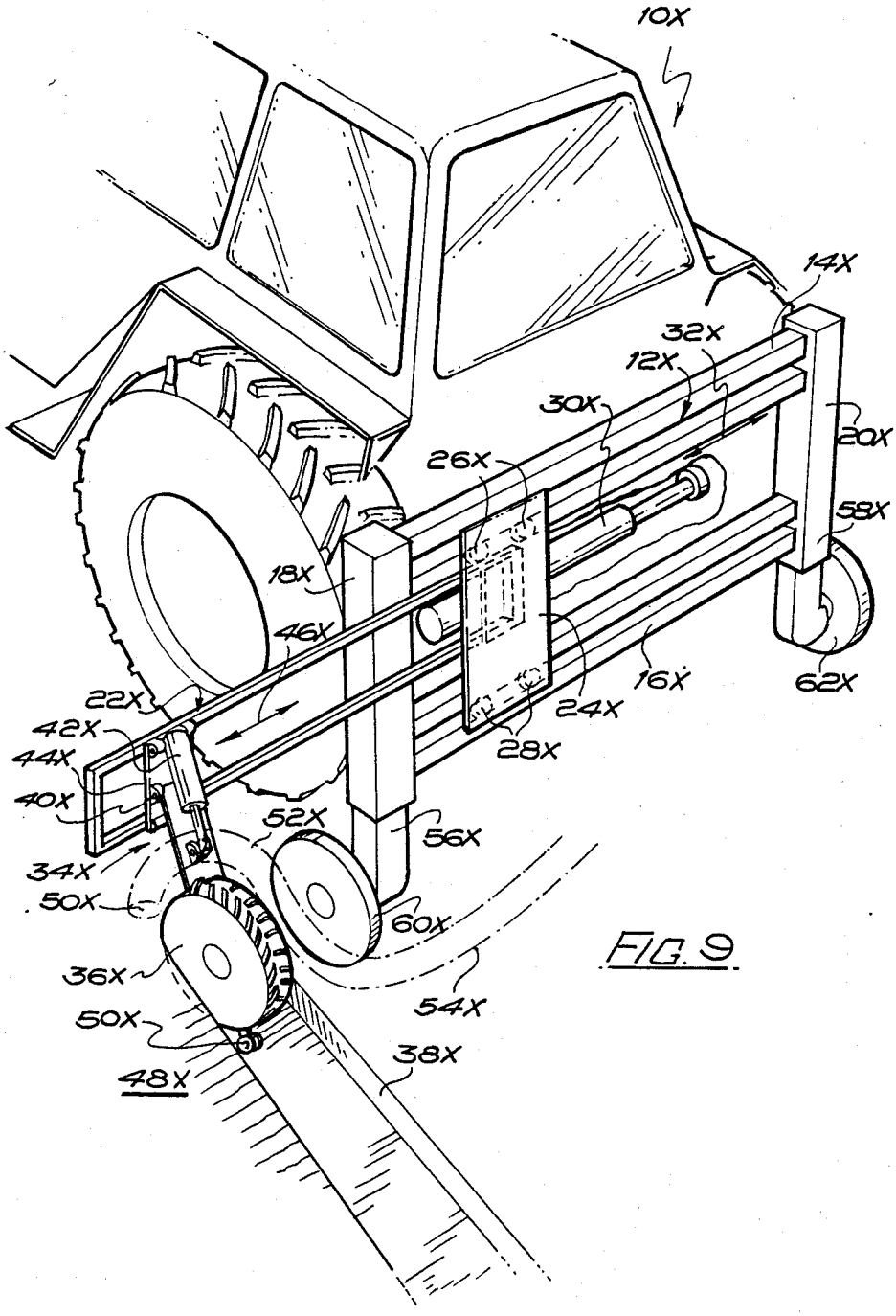
FIG. 9 is a diagrammatic perspective view of equipment according to another embodiment of the invention.

Referring to the embodiment of the invention shown in FIG. 9 the rear of a tractor vehicle (which may be an excavator vehicle) is indicated by reference numeral 10X. Attached to the rear of the vehicle is a frame 12X made up of upper and lower cross bars 14X, 16X and end posts 18X, 20X. The frame 12X may be of the type which is conventionally used for supporting a digger arm on the beams 14X and 16X so that the digger arm i slidable laterally of the frame across the rear of the tractor to any desired position.

Mounted on the beams 14X and 16X is a sub-frame 22X which is slidable on the beams 14X and 16X by means of a mounting plate 24X provided with slide rollers 26X, 28X. The mounting plate 24X is connected to a hydraulic displacement ram 30X which is mounted so as to be expanded and contracted as indicated by arrow 32X whereby the sub-frame 22X may be caused to project laterally of the tractor 10X as shown, and to be pulled inwardly so as not to project laterally of the tractor but to lie behind same.

On the sub-frame 22X is carried a cutting head 34X provided with a cutting means in the form of drum 36X adapted to cut slot 38X in a sidewalk surface. The drum 36X is pivotally mounted at 40X so as to be swingable in a vertical place by means of an adjustment ram 42X. The ram 42X and pivot 40X are carried by a plate 44X which is slidable on sub-frame 22X as indicated by arrow 46X. By so extending the ram 42X, so the cutter drum 36X can be made to penetrate the ground 48X to any required depth within the confines of the size of the cutter drum 36 but the depth of penetration is controlled by means of depth control wheels 50X forming part of the cutting head 34X. The depth control wheels 50X are adjustable relative to drum 36X for adjusting the depth of cut. The cutting head 34X also has a drive motor (not shown) for driving the drum 36X, and in addition there is a hood 52X to which is connected a suction pipe 54X (similar to pipe 218 in FIG. 8), the other end of which is connected to a source of suction such as a suction fan or the like whereby, when the cutter 36X is cutting, the chippings and debris created thereby can be sucked away through the suction pipe 54X leaving a clean and neat cut 38X.

The posts 18X and 20X for leg means which are telescopic and include struts 56X and 58X to the bottom ends of which are attached rollers 60X and 62X at least one of which is provided with a drive motor for the propelling of the apparatus as already described in relation to the previous embodiments. It is preferred that each of the wheels 60X and 62X be provided with a drive motor which is hydraulic in nature, and it is preferred that each roller is of the construction and is attached to the associated leg as shown in FIG. 10.

Figure 10:
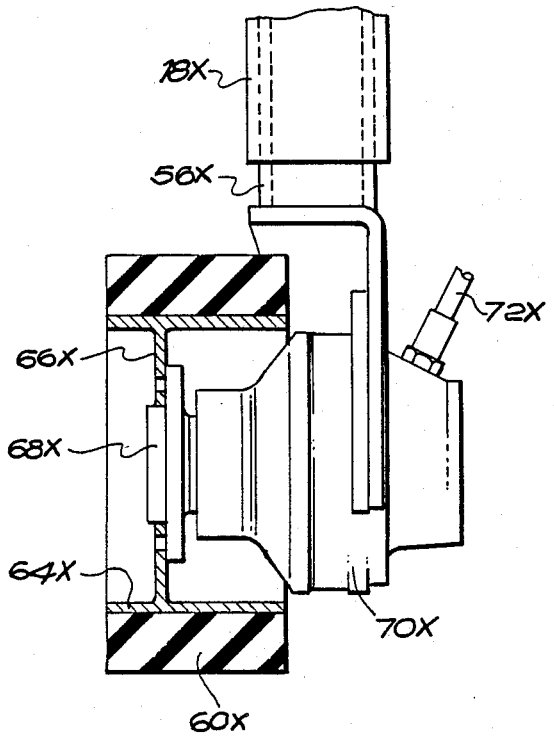
FIG. 10 is a sectional elevation taken through one of the drive wheels shown in FIG. 9.

Referring to FIG. 10, post 18X and strut 56X are shown as is roller 60X. Roller 60X comprises in fact a solid rubber tyre mounted on a wheel rim 64X having a wheel disc 66X connected to the output shaft 68X of the hydraulic motor 70X which receives hydraulic fluid for the driving of same through pipe 72X. Pipe 72X may be coupled to the hydraulics of the tractor vehicle 10X.

The operation of the equipment of FIGS. 9 and 10 is as follows. When it is desired to cut a slot or slots or groove or grooves in a footpath, the tractor 10X is positioned at the side of the footpath but on the road, and then the struts 56X and 58X are extended to bring the rollers 60X and 62X into engagement with the ground. Continued extension of the legs 56X and 58X causes the rear of the tractor 10X to lift from the ground so that the weight is taken by the rollers 60X and 62X. The depth of cut setting rollers 50X are fixed in relation to the drum 36X to provide a particular depth of cut, and then the beam 22X is projected laterally of the tractor to the desired position, and the ram 42X is extended bringing the cutter 36X, whilst being driven, into cutting engagement with the ground 38X. The cutter drum 36X is caused to penetrate the ground until the rollers 50X engage same and control the depth and in this position, the motors 70X are driven at a slow creep speed in order to cause the whole assembly to creep forward or rearwards to effect the cutting of a groove such as groove 38X as shown in FIG. 9. Instead of using a cutter drum 36X a cutter disc or disc cutters may be used for the cutting of a slot or slots.

Thus, the footpath can be cut, for whatever reason, without the weight of the tractor vehicle being placed thereon and this is particularly important as frequently footpaths are not designed, as are road surfaces, to accommodate heavy vehicles. Should the assembly encounter an obstruction on the footpath such as a lamppost or hydrant, then the sub-frame 22X can be retracted to an inner position until the obstruction is passed when the cutter can be repositioned to effect continued cutting operation. When such a manipulation takes place, of course the cutter 36X must be retracted from the ground.

Appropriate controls will be provided for enabling the driver of the tractor to control the operations described.

In a modified form of the arrangement of FIG. 9, instead of the sub-frame 22X being slidable laterally of the tractor, it may be adapted to be pivoted between a position behind the tractor, and a position overhanging the side of the tractor as shown.

It is of advantage to provide the cutter drum 36X with the depth control wheels 50X, because the inner roller 60X will have to travel through gulleys, grates and other undulations in the kerb of the highway which means that it will not follow an exactly horizontal path and if such movements were transmitted freely to the cutter 36X, then they would be reflected in the groove 38X which is cut by the cutter 36. The control wheels 50X provide independent depth control.

Figure 11:
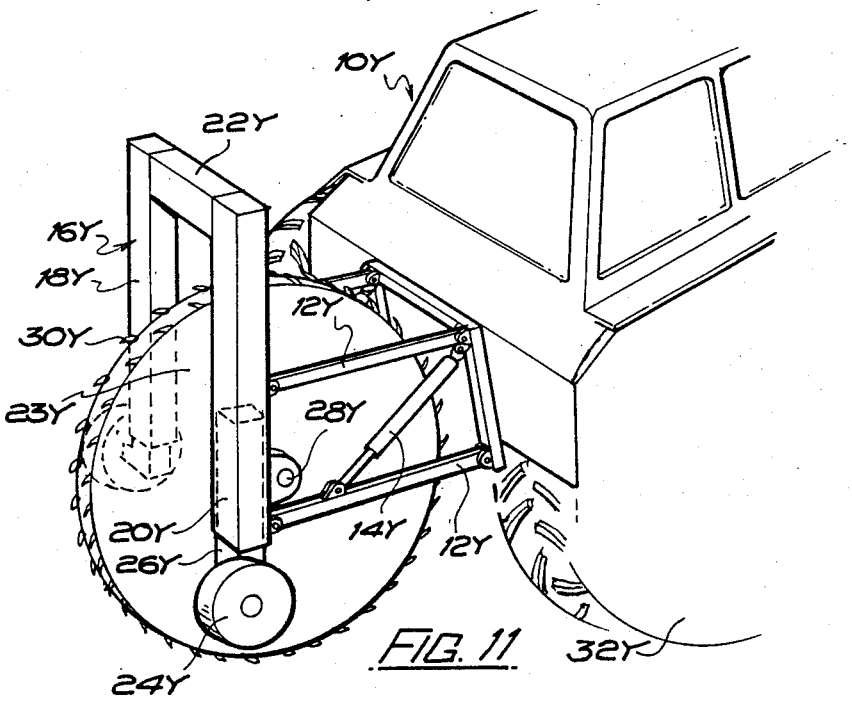
FIG. 11 is a perspective view of equipment according to another embodiment of the present invention.

Referring now to FIG. 11, in the embodiment shown, a tractor vehicle is indicated generally by reference numeral 10Y, and it is provided at its rear with a hitch assembly 12Y which is pivotable by means of the rams 14Y so that an inverted U-shaped frame 16Y can be raised and lowered relative to the rear of the tractor.

The frame 16Y has two outer legs 18T, 20Y and a connecting bridge piece 22Y. Between the legs 18Y, 20Y is a large cutter disc 23Y the purpose of which is to cut slots in the ground in the manner shown in FIG. 12.

At the lower end of each leg is a ground engaging drive wheel 24Y carried on a strut 26Y which slides in the associated leg, and there is a means inside the leg for jacking the roller 24Y up and down relative to the leg 20Y.

At least one of the rollers 24Y is coupled to a power means to enable the combination of apparatus and vehicle to be propelled forward or rearward as described herein.

The cutting disc 23Y is supported on bearings 28Y on the legs 18Y, 20Y, and there is also a power means for the driving of this cutter drum for the cutting of the slot in the road surface. The cutting drum is provided with cutting picks 30Y.

Figure 12:
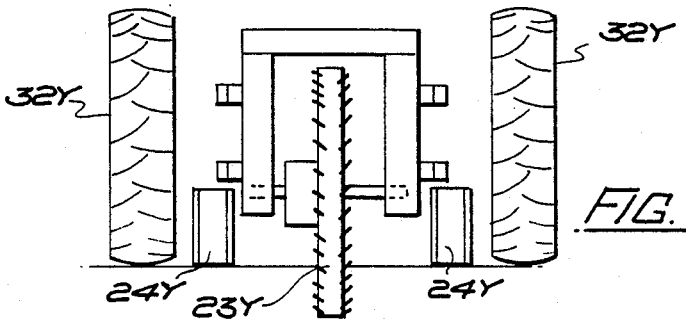
FIG. 12 is an end view of the equipment shown in FIG. 11.

The use of the combination shown in FIG. 11, is similar to the use of the equipment of earlier described embodiments in that the hitch 12Y is initially in the raised position, keeping the wheel 23Y and the frame 16Y clear of the ground. The rollers 24Y are set in position to control the depth of cut to be made by disc 23Y. When the tractor is in the correct position, the hitch is lowered by rams 14Y whilst the cutting disc 23Y is rotating, whereby the disc 23Y cuts and penetrates the ground as shown in FIG. 12 until the rollers 24Y contact the ground. The rams 14Y are jacked further downwardly until the rear wheels 32Y of the tractor are raised clear of the ground whereby the weight of the rear of the tractor is supported on the rollers 24Y. The rollers or at least one of the rollers is now driven by means of a hydraulic motor so that the whole assembly will creep forward at a slow and suitable speed for cutting whereby a straight slot will be cut in the road surface for the purposes as hereinbefore described. At the end of the cut the apparatus is raised by rams 14Y whereby the tractor wheels 32Y again engage the ground, and the hitch 12Y is raised raising the disc 23Y clear of the ground. The tractor can now be maneuvered into the next position which it is required to take up for making a further cut in the road surface or in fact can be driven from the site location to another site location.

Figure 13:
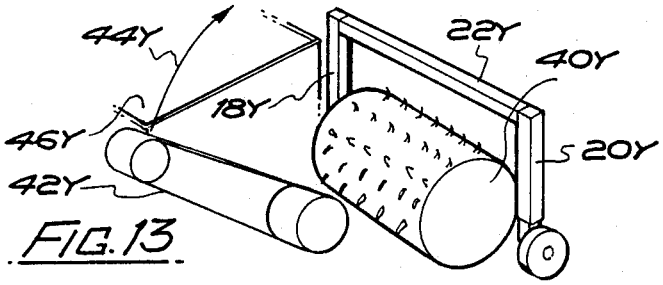
FIG. 13 is a perspective view of a modified form of the equipment shown in FIG. 11.

In the embodiment shown in FIG. 13, the principle difference is that instead of a disc 23Y, a planing drum 40Y is provided between the legs 18Y, 20Y, and the bridge piece 22Y is longer to accommodate the longer axial length of the drum 40Y.

Pivotally mounted on the frame 16Y is an elevator conveyor 42Y which is mounted so that it can be swung to an out of use position as indicated by arrow 44Y, and which in use serves to convey the chippings and spoils created by the cutting action of the drum 44Y up the upper reach 46Y of the conveyor and into a collecting hopper which may be carried by another vehicle or may be a stationary skip.

In the arrangement described in relation to FIGS. 11 and 12, it is not necessary that the disc should be capable of being moved transversely relative to the rear of the tractor.

Referring now to the embodiment of the invention shown in FIG. 8, the tractor 10Z is of similar construction to the tractor 10X shown in FIG. 9 insofar as the tractor has at the rear thereof a frame 12Z having side posts 14Z and 16Z, connected by transverse beams 18Z and 20Z. Each of the posts 14Z and 16Z is in the form of telescopically interfitting parts to define support legs, and at lower ends of struts 22Z and 24Z are roller means in the form of roller wheels 26Z and 28Z which typically are of the construction hereinbefore described in relation to earlier embodiments.

Slidably mounted on the beams 18Z and 20Z is a support plate 30Z, the support plate 30Z supporting the cutting head 32Z which is in the form of a pivot arm 34Z which can be swung about pivot 36Z by means of an expansible and contractible hydraulic ram 38Z pivotally connected between the plate 30Z and the arm 34Z at pivot points 40Z and 42Z.

At the outer end of the arm 34Z is the cutting means in the form of a cutting disc or drum 44Z, the drum having adjustable depth control wheels 46Z which operated in the same fashion as the depth control wheels 50X described in relation to FIG. 9.

The plate 30Z is adjustably mounted on the beams 18Z and 20Z by means of a hydraulic ram 48Z which is connected between the plate 30Z and a clamping bar 50Z which is releasably clamped to the beams 18Z and 20Z by clamp devices 52Z and 54Z. When it is desired to displace the plate 30Z on beams 18Z, 20Z, as indicated by arrow 56Z, the clamping devices 52Z and 54Z are locked clamping the bar 50Z to the beams 18Z and 20Z. The ram 48Z is now expanded or contracted by the operation of control devices in the cabin 58Z of the tractor 10Z under the control of an operator 60Z to cause the plate 30Z to be moved on the beams 18Z and 20Z to the desired position.

In this particular tractor 10Z, the operator 20Z can sit facing either direction. In other words he can sit facing forwards so that the vehicle can be driven forwards in the normal manner, or he can sit facing rearwards, to operate a rear movement steering wheel 64Z for steering the vehicle whilst it moves in the reverse direction. The reverse movement will be utilised in particular when the cutting head 32Z is in operation.

Figure 14:
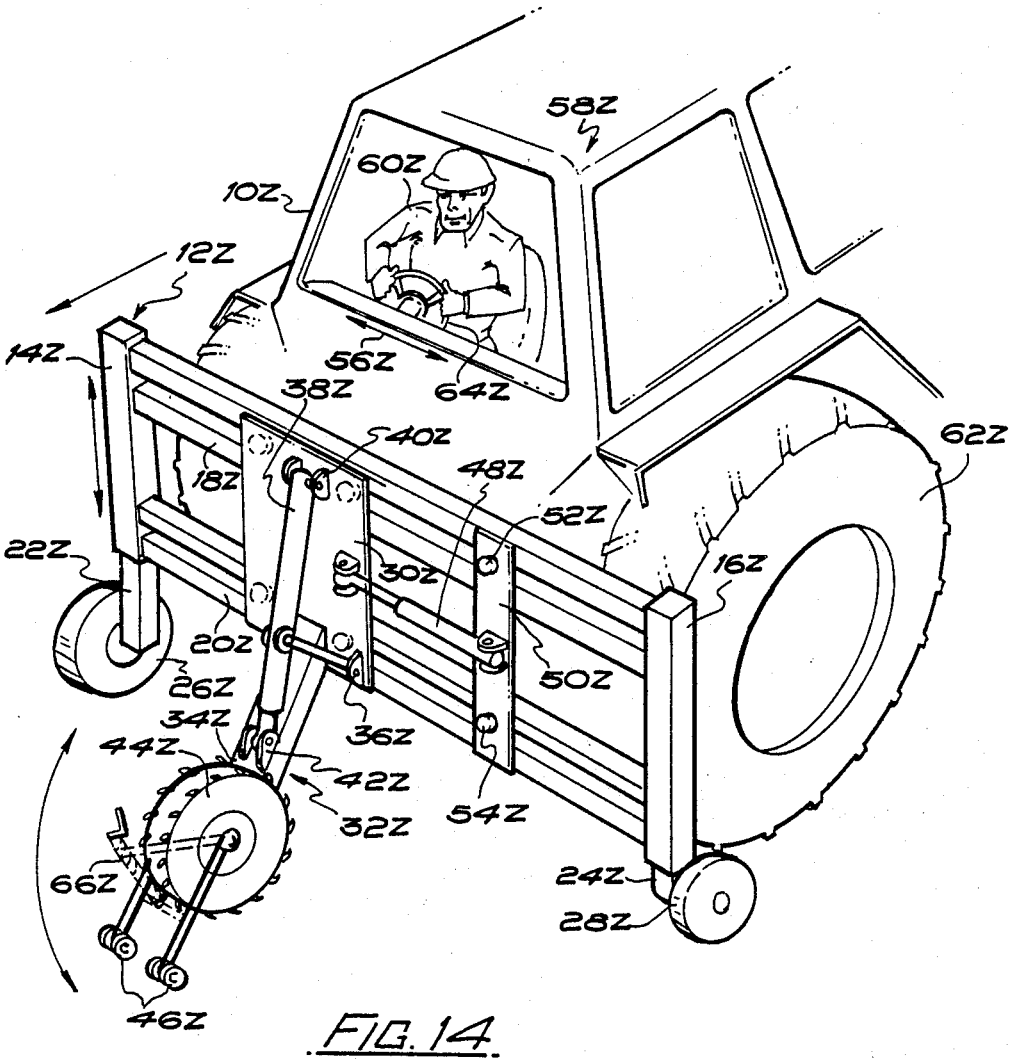
FIG. 14 is a perspective diagrammatic view of equipment according to still a further embodiment of the invention.

Thus, in operation of the arrangement shown in FIG. 14, the driver when he requires to make a cut in the road surface will set facing rearwards as shown in FIG. 14. He will then jack down the wheels 26Z and 28Z until the rear wheels 62Z of the tractor are raised clear of the ground. He will then, after previously having set the position of the adjustable depth wheel rollers 46Z by operation of a screw jack device 66Z, lower the arm 34Z until the cutting means 44Z, which is being driven, enters the road surface and penetrates same to the depth dictated by the wheels 46Z. The driver now simply drives the whole equipment in reverse direction by operating the drive motor or motors coupled to one or both of wheels 26Z and 28Z so that the whole equipment moves forward at creep speed whilst cutting is being effected. By virtue of the driver facing rearwards and steering the vehicle whilst it moves in a rearwards direction, he can not only see the cutting operation but can control the line of the cut by appropriate steering of the vehicle. The tractor 10Z shown in FIG. 14 will preferably be an adapted excavator vehicle of the type normally provided with he frame comprising posts 14Z and 16Z and beams 18Z and 20Z. By using the jack 38Z to swing the arm 34Z downwards to a cutter operating position, the cutting disc or drum 44Z can be forced into the ground and kept firmly in engagement with the ground, which is an advantageous arrangement.

In an alternative form of the arrangement shown in FIG. 14, the cutter disc or drum 44Z is mounted so as to be raised and lowered vertically by a hydraulically operated telescopic leg arrangement, in which case the drum or disc 44Z could be located closer to the plane containing the legs 14Z and 16Z.

Figure 15:
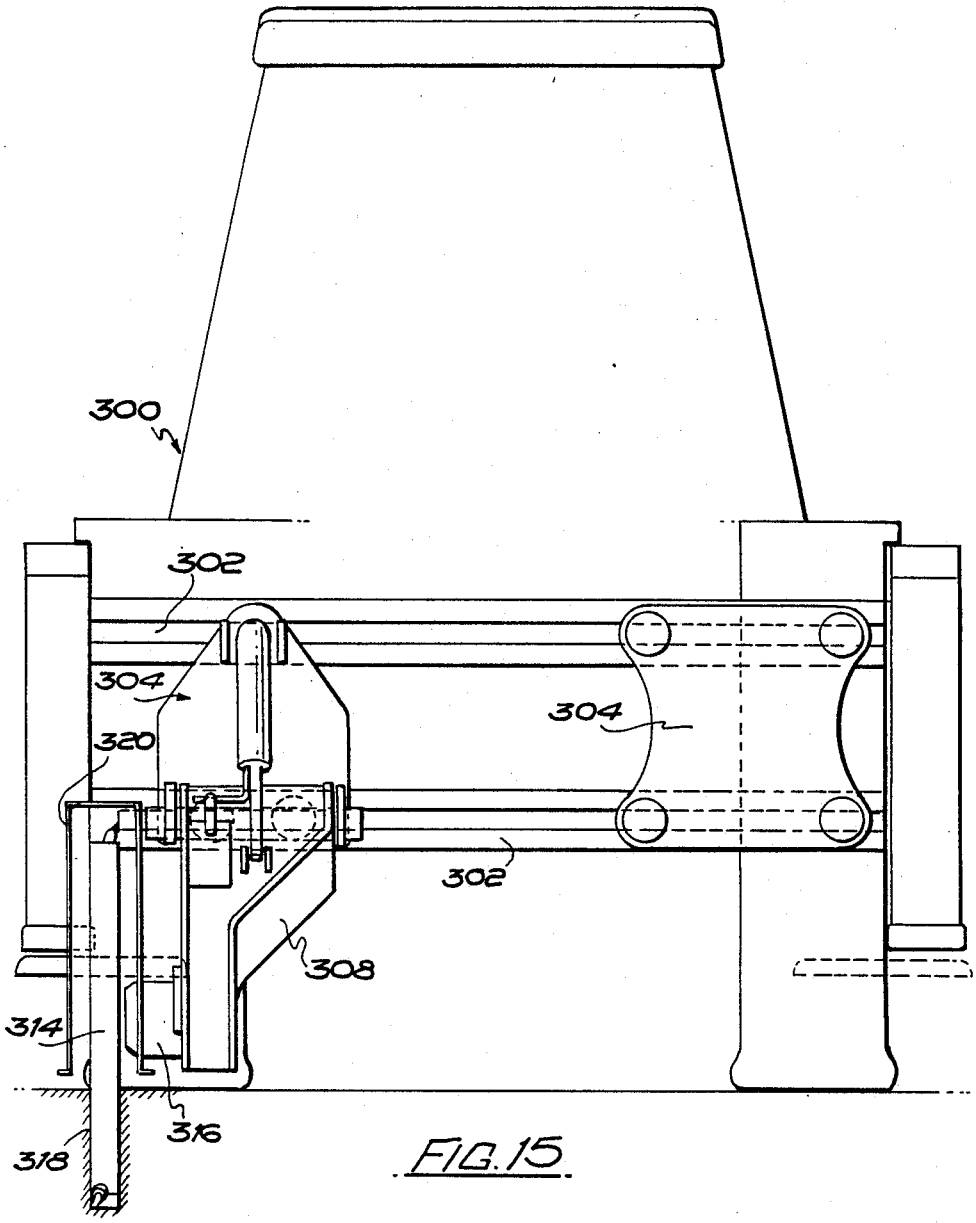
FIG. 15 is a rear view of a vehicle with an attachment according to a still further embodiment of the invention.
Figure 16:
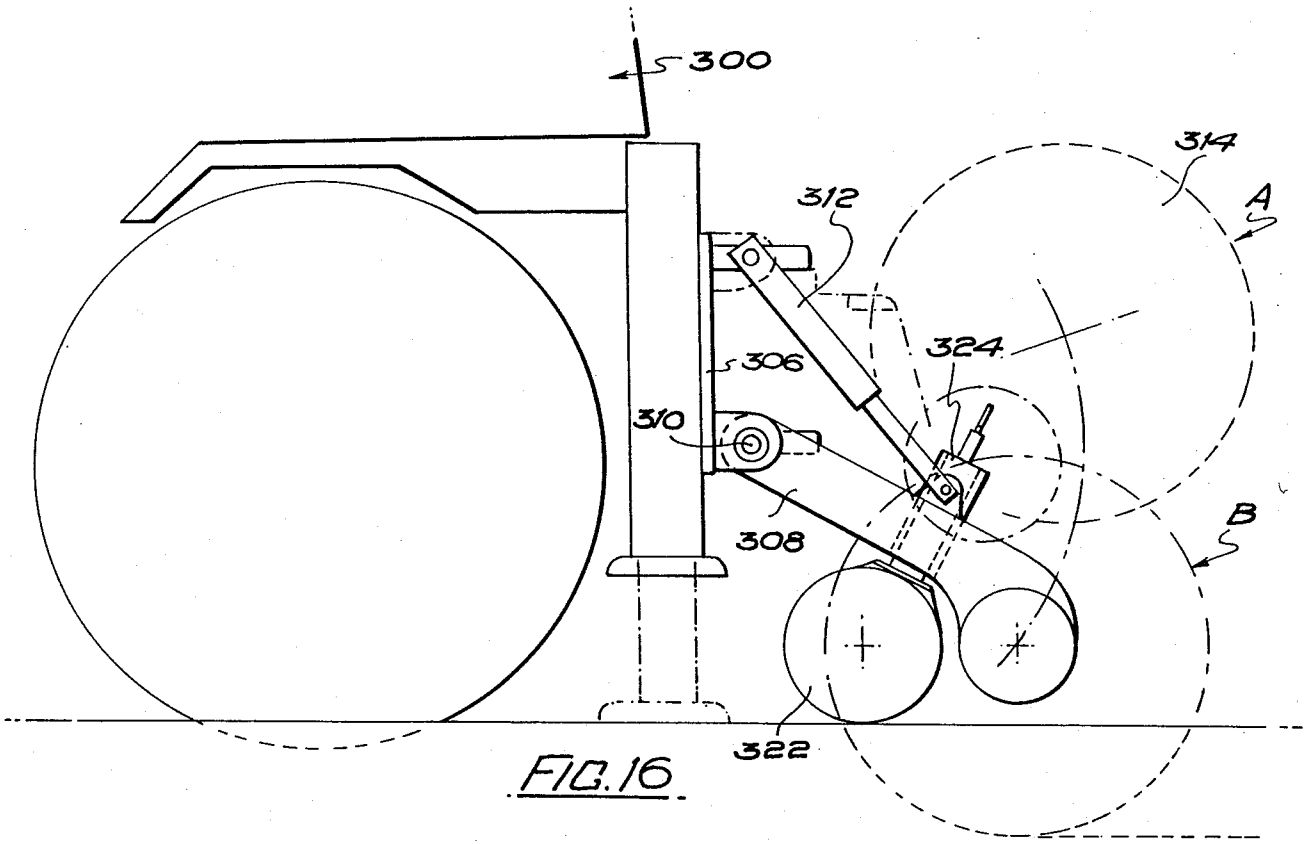
FIG. 16 is a side elevation of the arrangement shown in FIG. 15.
Figure 17:
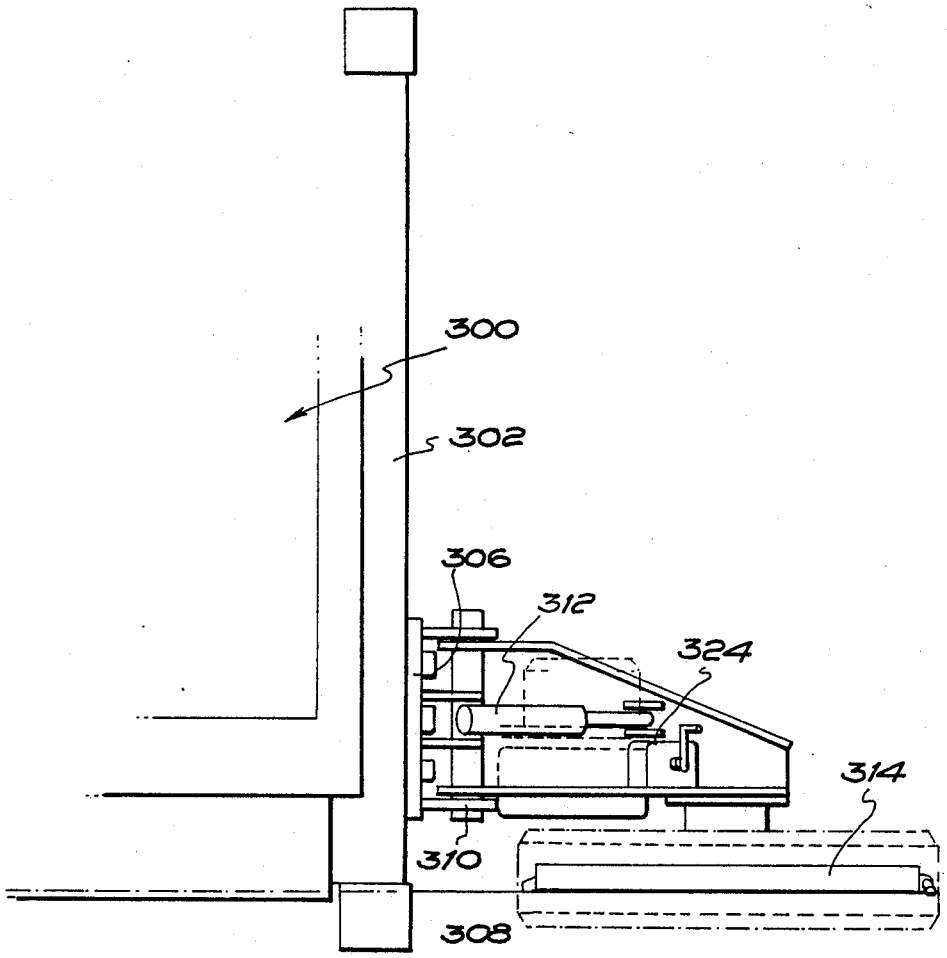
FIG. 17 is a plan view of the arrangement shown in FIGS. 15 and 16.

In the embodiment of the invention shown in FIGS. 15, 16 and 17, an excavator vehicle 300 as is conventional is provided at the rear with slide beams 302 on which is carried, on a mounting 304, the conventional excavator arms (not shown).

Also carried by the slide beams 302 is an attachment 304 in accordance with the present invention. The attachment comprises a mounting plate 306 upon which is pivotally mounted an arm assembly 308 at the pivot point 310, and the arm assembly can be pivoted in pivot pont 310 by means of a fluid pressure operated ram 312 between a transport position indicated at "A" and an in-use or working position indicated at "B".

The arm 308 carries a cutter disc 314 which is a slot cutter and as shown in FIG. 15 is located to one side of the arm and is adapted to be driven by means of a motor 316 to cut a slot 318 in the ground. A cover 320 covers the disc 314.

The arm 308 also carries a depth control and drive roller 322, the position of which in relation to the arm 308 can be adjusted by a screw device 324. The roller 322 is connected to a drive motor, for the rotation of same for the propulsion of the assembly in the manner already described.

With the embodiment of FIGS. 15 to 17, slot cutting can take place whilst the excavator arms remain on the vehicle.

The drive for the roller 322 preferably will be a hydraulic motor supplied with hydraulic fluid from the vehicle 300.

In each of the embodiments, the drive to the ground engaging roller may be under automatic control depending upon the resistance experienced by the cutting disc or drum during the cutting operation. That is to say if the cutting disc or drum meets a relatively soft portion of road surface, such that the resistance to cutting decreases and there will be a tendency for the vehicle to accelerate, the driving effort applied to the roller propelling the whole assembly would be automatically reduced until greater resistance was experienced by the cutting disc or drum when the driving torque would again be increased.

Various embodiments of the invention have been described, and the various embodiments have different constructional arrangements. It is to be pointed out that any appropriate constructional arrangement of any embodiment can be used in connection with any other embodiment.

The vehicle which is used for the equipment may be any suitable such as a tractor of the agricultural or industrial type, or an excavator vehicle, or simply a road going lorry or other commercial vehicle. In some cases part of the frame is already part of an existing vehicle type such as an excavator, whilst in other cases it will be necessary for the whole supporting and cutting apparatus to be connected to the vehicle as a separate unit. The invention also resides of course in the provision of as much of the apparatus as may be necessary for attachment to an existing vehicle.

An advantage of all of the embodiments described is that the cutting means will be loaded by the weight of the vehicle and will therefore remain stable. Additionally, the vehicle will be supported on the roller means which can be designed so as to eliminate bounce and jump. It is not necessary to provide the vehicle with a special creep speed gearbox, although it is not outside the scope of the invention to provide such a creep speed gearbox and to drive the vehicle wheels or tracks which remain in contact with the ground when the vehicle is partly jacked up on the support legs.

In some embodiments, the position of the cutting means can be adjusted widthwise of the vehicle, enabling the vehicle to work within a relatively narrow width but still to remove a substantially wide strip of roadway surface. This is important as concerns the disturbance to traffic.

The equipment furthermore can be moved readily from place to place by raising the support and cutting apparatus and using the vehicle to drive from place to place.

In any of the embodiments, the apparatus may be adapted to be driven in a rearwards direction, with appropriate positioning for the operator so that he can face either forwards or rearwards and when facing rearwards can still control the steering of the equipment, suitably for example by providing an alternative rearwardly facing steering wheel.

In each of the embodiments of the invention, it is preferably arranged that the support legs be disposed at a slight angle to the vertical, either forwards or rearwards, so that when the weight of the vehicle is supported on such legs, the relatively telescoping members will be to some extent wedged together which keeps the equipment more stable in use.

I claim:

1. Road cutting equipment including a conventional, roadgoing traction vehicle which when travelling from place to place runs on ground engaging wheel means, said equipment comprising:

(a) a vehicle having a power unit for driving the vehicle along the road, (b) cutting and supporting apparatus, (c) drive rollers on said apparatus, (d) a road cutting means on said apparatus, (e) power means for driving the road cutting means, (f) jacking means mounting the said apparatus on the vehicle so that the apparatus overhangs one end of the vehicle, said jacking means being operable to raise and lower said apparatus relative to the adjacent end of the vehicle between a raised transport position in which the drive rollers and cutting means are clear of the road so that the vehicle can be driven on the road at normal speed by means of its power unit, and a lowered cutting position in which the cutting means and drive rollers engage the road and the adjacent end of the vehicle is thereby jacked clear of the road, and including (g) a creep speed drive means which is independent of the vehicle power unit connected to the drive rollers for the propulsion of the entire equipment at creep speed by means of the creep speed drive means and the drive rollers while the adjacent end of the vehicle is raised clear of the road and the cutting means is driven to cut the road surface.

2. Road cutting equipment according to claim 1 wherein said cutting and supporting apparatus comprises a cutting head having a road cutting means and support leg means having roller means at the lower ends thereof.

3. Road cutting equipment according to claim 2 wherein the cutting head and support leg means are capable of being raised and lowered together relative to the vehicle.

4. Road cutting equipment according to claim 1, wherein said means for propulsion comprises a hydraulic motor.

5. Road cutting equipment according to claim 3, wherein said support leg means comprise two support legs located at opposite ends of a frame; said frame being arranged adjacent said end of the vehicle so that said legs are at the respective sides of the vehicle.

6. Road cutting equipment according to claim 2, wherein each leg is telescopic and can be adjusted in length.

7. Road cutting equipment according to claim 5, wherein said cutting head is carried out by said frame.

8. Road cutting equipment according to claim 7, wherein said cutting head is movable on said frame in a direction from side-to-side of the vehicle.

9. Road cutting equipment according to claim 5 wherein the frame is of inverted U-shape and the cutting head lies between the legs of the U-shaped frame, the said U-shape forming said support legs.

10. Road cutting equipment according to claim 5 wherein the cutting head is mounted on the frame for vertical adjustment thereon.

11. Road cutting equipment according to claim 10, including a sub-frame carried by the frame for horizontal movement thereon, said sub-frame being adapted to be positioned to overhang the vehicle side, said cutting head being carried by the sub-frame so that the cutting means can be positioned beyond the side of the vehicle so as to cut the surface of a footpath.

12. Road cutting equipment according to claim 11, wherein the cutting head is carried for said vertical adjustment by being pivotable about a horizontal axis, the means for effecting said vertical adjustment comprising a hydraulic ram.

13. Road cutting equipment according to claim 2 wherein the cutting head comprises a cutter disc or drum.

14. Road cutting equipment according to claim 13 including depth control wheels carried by the cutter head to control the depth to which the disc or cutter drum can penetrate the road surface during the cutting operation.

15. Road cutting equipment according to claim 1 wherein the apparatus comprises a mounting for mounting on a cross slide of an excavator said mounting carrying a pivot arm pivotally mounted at one end to said mounting, and at the other end carrying a cutting disc or drum, and including means for pivoting the arm between an operational position in which the cutting means can cut the road surface, and a raised out-of-use position, and also including a depth control and drive roller carried by the arm and means for driving the roller to propel the vehicle and road cutting equipment when in the operational position.

* * * * *